US005966743A

United States Patent [19]

Flann

[11] Patent Number: 5,966,743

[45] Date of Patent: Oct. 19, 1999

[54] SUBSTANCE DISPENSING HEADGEAR

[76] Inventor: Randall D. Flann, 413 W. Mineral St., Room 7, Milwaukee, Wis. 53204-1741

[21] Appl. No.: 09/020,605

[22] Filed: Feb. 9, 1998

[51] Int. Cl.[6] ..... A42B 1/02

[52] U.S. Cl. ..... 2/209.13; 2/209.11

[58] Field of Search ..... 2/209.13, 171, 2/209.11, 209.12; 222/175, 78; 224/148.2, 148.7, 181; 446/26, 27

[56] References Cited

U.S. PATENT DOCUMENTS

| | | | |
|---|---|---|---|
| D. 20,079 | 8/1890 | Proeger | D7/5 |
| D. 247,408 | 3/1978 | Ventura | D7/5 |
| D. 278,016 | 3/1985 | Myrbo | D7/9 |
| D. 279,752 | 7/1985 | Jagger | D7/10 |
| D. 283,866 | 5/1986 | Campbell | D7/13 |
| D. 292,330 | 10/1987 | McColough | D29/15 |
| D. 363,145 | 10/1995 | Newman | D29/106 |
| D. 372,572 | 8/1996 | Conran | D2/876 |
| D. 375,870 | 11/1996 | Stonehouse | D7/523 |
| 1,021,323 | 3/1912 | McMurtry | 2/209.13 |
| 3,491,374 | 1/1970 | Frango | 2/171 |
| 3,602,386 | 8/1971 | Brime | 215/363 |
| 3,631,793 | 1/1972 | Bednartz | 99/295 |
| 3,710,393 | 1/1973 | Douglas | 2/14 W |
| 3,978,527 | 9/1976 | Bednar | 2/68 |
| 4,293,960 | 10/1981 | Palmaer | 2/416 |
| 4,335,471 | 6/1982 | Quigley, Jr. | 2/12 |
| 4,681,244 | 7/1987 | Geddie | 222/175 |
| 4,739,905 | 4/1988 | Nelson | 222/175 |
| 4,881,654 | 11/1989 | Stazo | 220/85 H |
| 4,921,141 | 5/1990 | Branum | 222/175 |
| 4,971,231 | 11/1990 | Faerber | 222/559 |
| 5,076,463 | 12/1991 | McGraw | 220/415 |
| 5,077,836 | 1/1992 | Idoff | 2/10 |
| 5,148,950 | 9/1992 | Hosaka | 222/175 |
| 5,417,327 | 5/1995 | Saumure | 206/427 |
| 5,597,087 | 1/1997 | Vinarsky | 220/482 |
| 5,597,089 | 1/1997 | Smith | 220/710 |
| 5,597,090 | 1/1997 | Leahy | 222/1 |
| 5,597,097 | 1/1997 | Morris | 222/529 |
| 5,636,766 | 6/1997 | Delameter | 222/183 |

*Primary Examiner*—Diana L. Biefeld
*Attorney, Agent, or Firm*—Ryan Kromholz & Manion

[57] ABSTRACT

A headgear for dispensing a substance has a container to carry the substance. A spigot is secured to the container. The spigot can be opened to dispense the substance by gravity, suction, pressure or levity flow when the container. The spigot can be closed to retain the substance in the chamber. A hat-like recess is formed within the bottom wall of the container sized for wearing on an individual's head, and for maintaining the container in a freestanding condition during hands-free ambulation of the individual.

12 Claims, 6 Drawing Sheets

FIG. 4
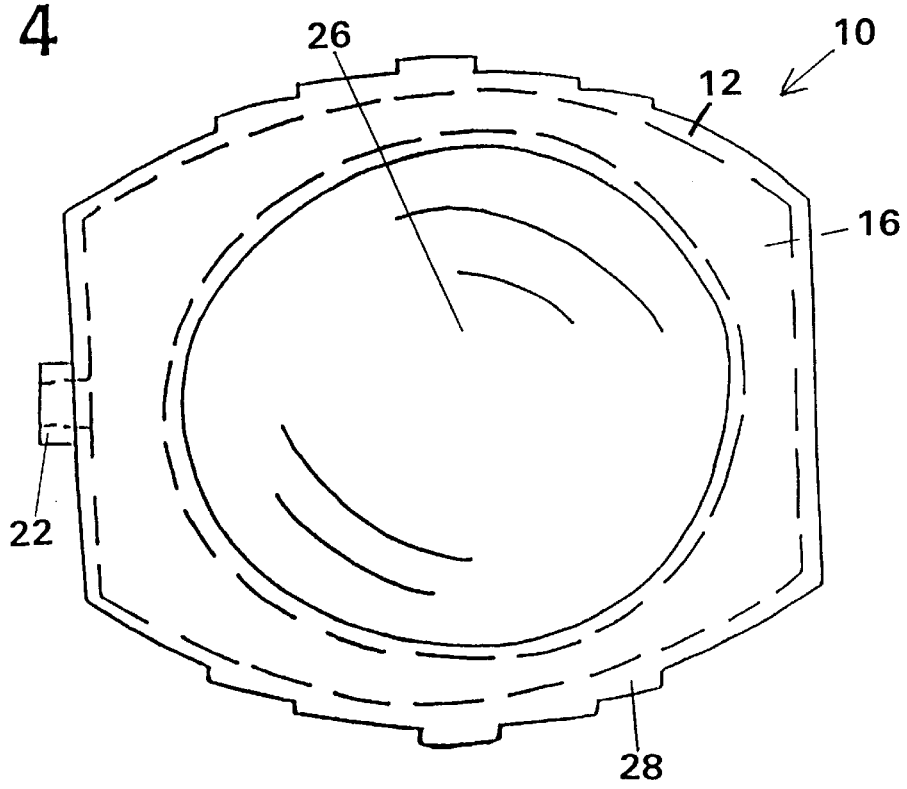
FIG. 5
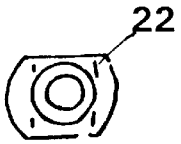
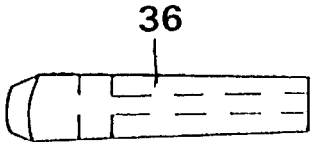
FIG. 6
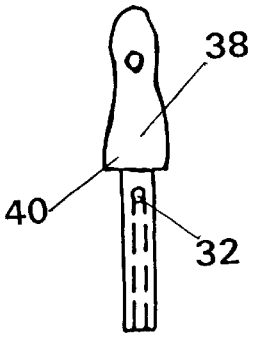
FIG. 7

SUBSTANCE DISPENSING HEADGEAR

BACKGROUND OF THE INVENTION

Based upon a need for containing a substance centuries ago, a vessel was invented. Later, to dispense the substance, a spigot was invented. Both are stationary devices. Transporting the substance was either by animals, or mechanical means, with limited, restrictive, and or regulated distances, and locations.

SUMMARY OF THE INVENTION

To resolve this, the inventor has invented a means for transporting a substance, by way of the contained substance being equally distributed upon a person's head resulting in the holding, dispensing, and transportability of the substance, to, from, and at a location, during any time.

The invention comprises wearable headgear for holding, and dispensing a substance, to, from, and at a location. It is worn upon a person's head for access at a location, during any time without hindering, or obstructing the wearer's use of other appendages.

The headgear has advantages, which solves previously existing problems of a contemporary container, which was heavy, unmanageable, and remained stationary. The headgear is made of molded Food Grade plastic, resulting in being lightweight, and transportable.

Its wearability upon a person's head allows the substance to be held, transported, and dispensed to, from, and at a location for instantaneous usability, and frees the wearer's hands, for other purposes.

One aspect of the invention provides a transportable dispensing receptacle for a substance. The receptacle comprises a container enclosing a chamber to carry the substance. The container includes a bottom wall defining a generally flat surface to maintain the container in a freestanding condition when placed on a horizontal surface. The receptacle also provides a spigot spaced above the bottom wall and secured to the container in communication with the chamber. The spigot carries a valve including an external handle to manually move the valve between an opened and a closed position. In the opened position, the valve opens communication with the chamber to dispense the substance by gravity, suction, pressure or levity flow when the container is in the freestanding condition. In the closed position, the valve closes communication with the chamber to retain the substance in the chamber. The receptacle further includes a hat-like recess formed within the bottom wall sized for wearing on an individual's head and for maintaining the container in the freestanding condition during hands-free ambulation of the individual.

In one embodiment, the container includes a mount for the spigot including means for removing the spigot from the mount for repair or replacement with another spigot.

In one embodiment, the container includes an identifiable spatial form.

In one embodiment, the spigot includes an identifiable spatial form.

In one embodiment, the container includes a fitting or recess to support an external object.

In one embodiment, the container encloses a second chamber to carry a substance and further includes a second spigot in communication with the second chamber.

In one embodiment, insulating material surrounds the chamber.

Another aspect of the invention provides a transportable receptacle for dispensing a substance comprising a container enclosing a chamber to carry the substance. The container includes a bottom wall defining a generally flat surface to maintain the container in a freestanding condition when placed on a horizontal surface. The receptacle also includes a mount in the container spaced away from the bottom wall.

According to this aspect of the invention, the receptacle includes a family of spigots presenting different identifiable spacial forms. The spigots are constructed and arranged for interchangeable placement on or in the mount in communication with the chamber. Each spigot includes a valve to regulate gravity, suction, pressure or levity flow of the substance through the spigot when the container is in the freestanding condition. The receptacle also includes a hat-like recess formed within the bottom wall. The hat-like recess is sized for wearing on an individual's head and for maintaining the container in the freestanding condition during hands-free ambulation of the individual.

In one embodiment, the valve of at least one of the spigots includes an external handle to manually move the valve between an opened position, opening communication with the chamber to dispense the substance by gravity, suction, pressure or levity flow when the container is in the freestanding condition, and a closed position, closing communication with the chamber to retain the substance in the chamber.

In one embodiment, the container includes an identifiable spatial form.

Another aspect of the invention provides a family of transportable receptacles for dispensing substances. The family of receptacles comprises a family of containers presenting different identifiable spacial forms. Each container enclosing a chamber to carry a substance and includes a bottom wall defining a generally flat surface to maintain the container in a freestanding condition when placed on a horizontal surface. Each container also includes a mount spaced from the bottom wall, and a hat-like recess formed within the bottom wall sized for wearing on an individual's head and for maintaining the container in the freestanding condition during hands-free ambulation of the individual.

The family also includes a family of spigots presenting different identifiable spacial forms. Each spigot is constructed and arranged for interchangeable placement on or in the mount in communication with the chamber. Each spigot includes a valve to regulate flow of the substance by gravity, suction, pressure or levity through the spigot when the container is in the freestanding condition.

In one embodiment, the valve of at least one of the spigots includes an external handle to manually move the valve between an opened position, opening communication with the chamber to dispense the substance by gravity, suction, pressure or levity flow when the container is in the freestanding condition, and a closed position, closing communication with the chamber to retain the substance in the chamber.

BRIEF DESCRIPTION OF THE DRAWINGS

FIG. 4 is a bottom view of the headgear shown in FIG. 1;

FIG. 5 is an end view of a spigot mount located in the headgear shown in FIG. 1;

FIG. 6 is a side view of a plug that is placeable in the mount shown in FIG. 5, as shown in FIG. 1;

FIG. 7 is a side view of a tap that the plug shown in FIG. 6 carries, as shown in FIG. 1;

DESCRIPTION OF THE PREFERRED EMBODIMENT

Figure 1:
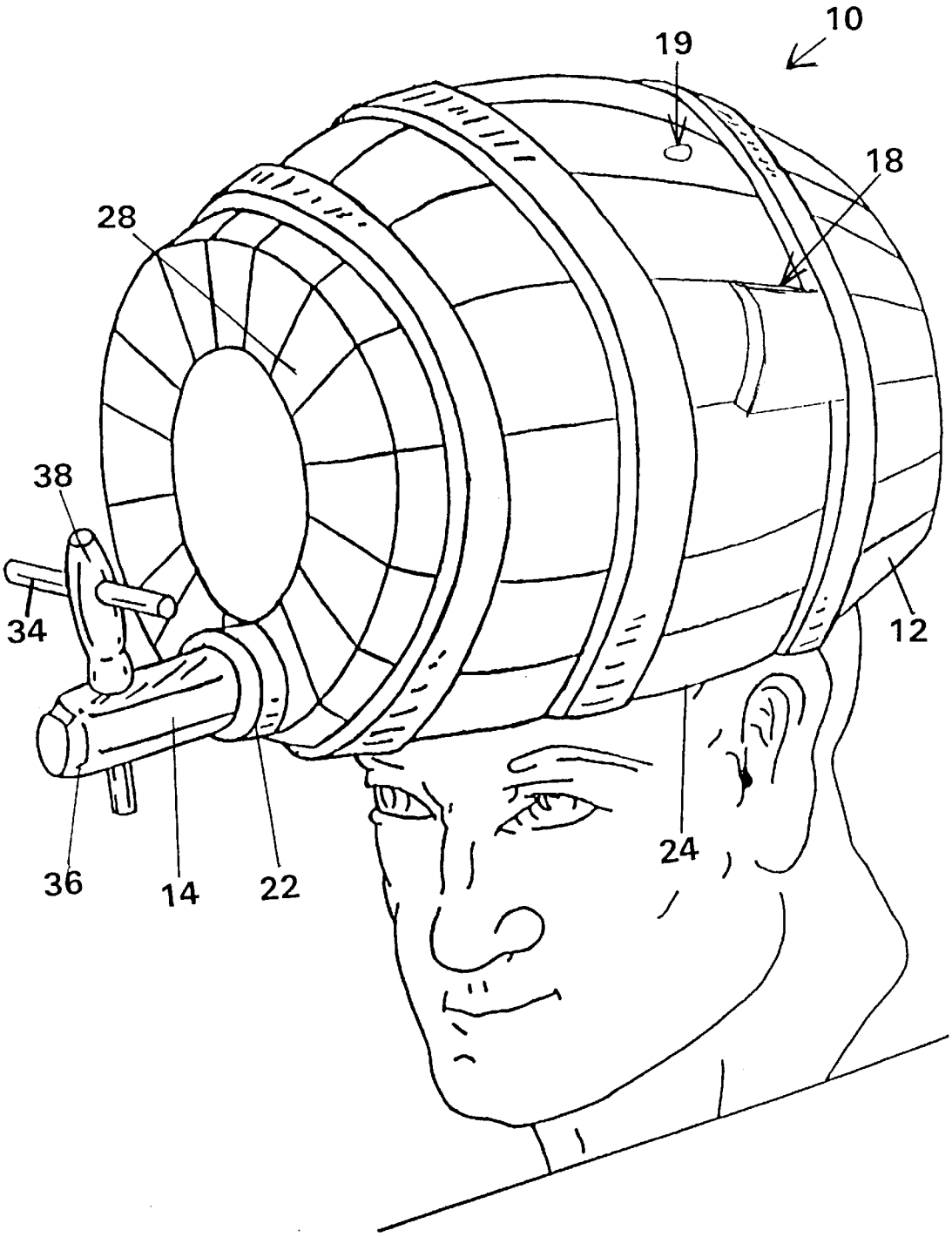
FIG. 1 is a side perspective view of a substance dispensing headgear that embodies features of the invention.
Figure 2:
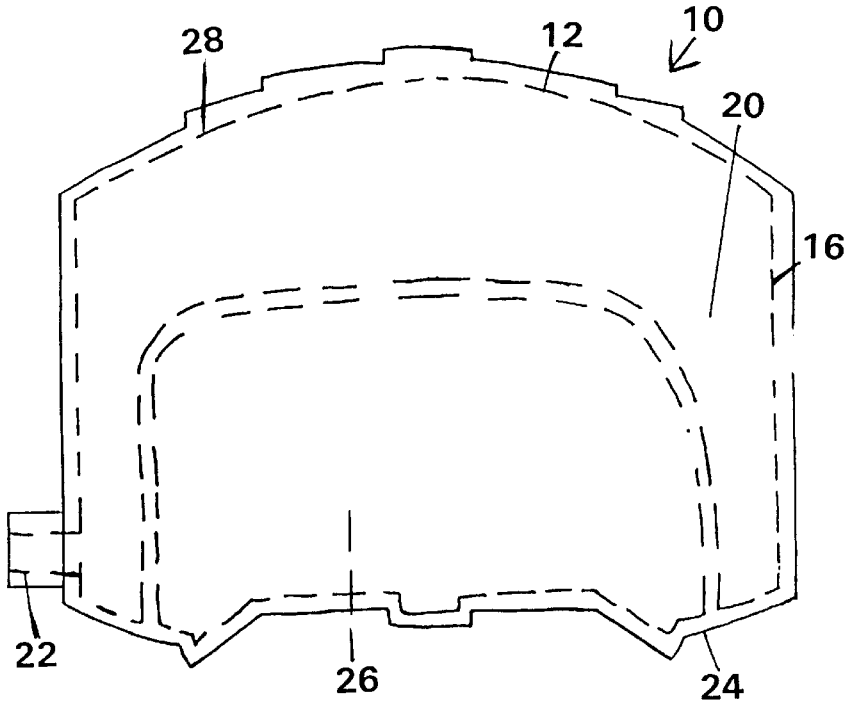
FIG. 2 is a side view of the headgear shown in FIG. 1.
Figure 3:
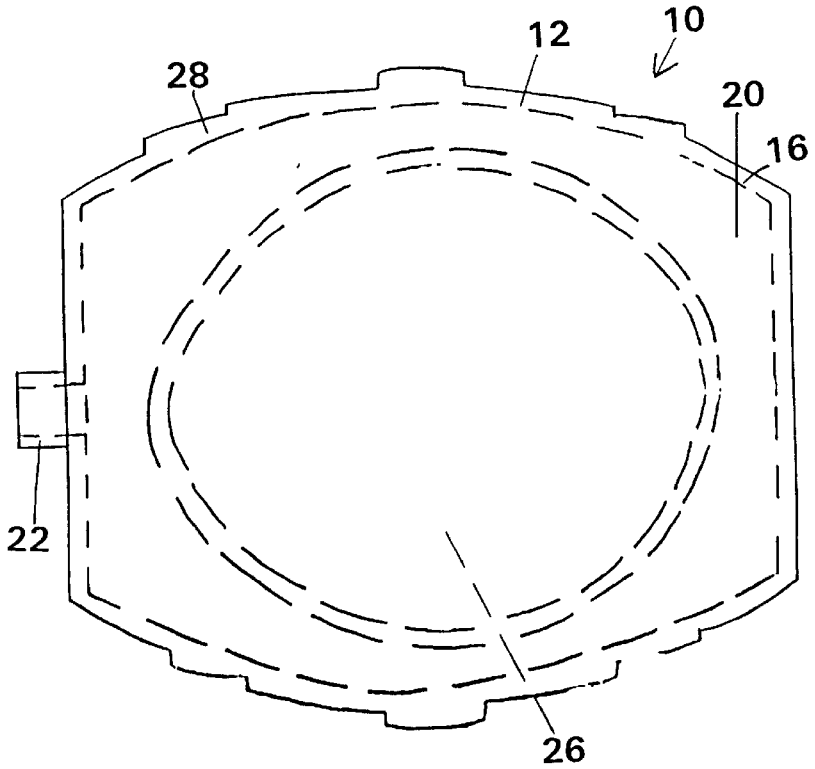
FIG. 3 is a top view of the headgear shown in FIG. 1.

The transportable receptacle 10 shown in FIGS. 1 to 4 comprises a molded headgear/hat 12, and a spigot 14. The headgear/hat 12, and the spigot 14 are made from one and, or more, types of food grade plastics, such as low density polyethylene LDPE), high density polyethylene (HDPE), polyethylene terephthalate (PET) or polyvinyl chloride (PVC).

Figure 8:
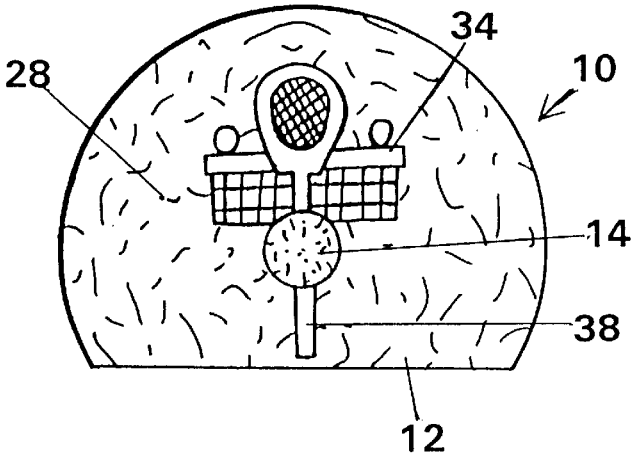
FIGS. 8 to 10 show transportable, substance dispensing headgears comprising ball-shaped containers having different spatial forms and spigots having different spacial forms, shown mounted on the headgears.
Figure 9:
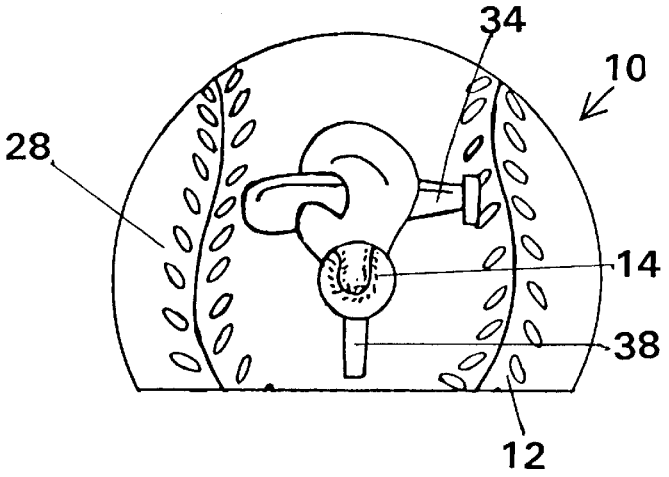
Figure 10:
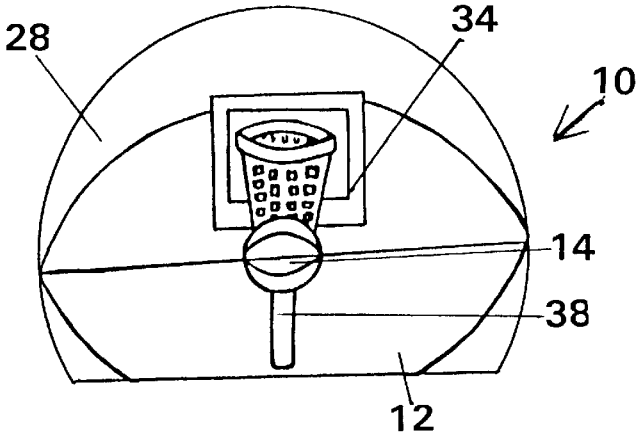
Figure 14:
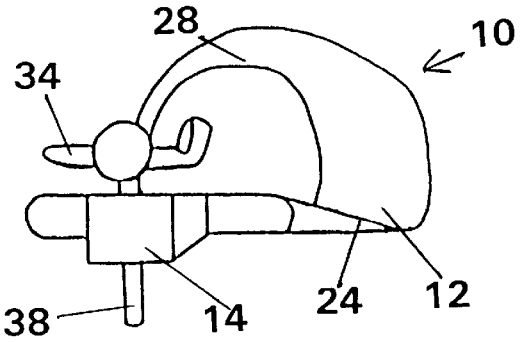
FIG. 14 is a side perspective view of a transportable, substance dispensing headgear comprising a hat-shaped container and spigots shown mounted on the headgear.

The size and shape of the headgear/hat 12 or spigot 14 may be varied to unlimited range (made smaller or larger, and appearance unlimited), as FIGS. 8 to 10 and FIG. 14 show by way of example. The color may be varied to unlimited range. The unlimited range, means that the color may be altered, in tint, and or, tone.

The spigot 14 for one headgear/hat 12 is interchangeable, interconnecting, and functional with any another headgear/hat 12.

Interior, or exterior insulation 16 may be incorporated into headgear/hat. Eye ring, or eye rings; slot, or slots; compartment, or compartments, concave or convex form, or forms (see, e.g., reference numeral 18 in FIG. 1), may be utilized on any headgear/hat 12.

The headgear/hat 12 includes a chamber 20, which holds a predetermined amount of substance. Its containing capacity is not limited to liquid alone. A gelatin, and, or solid compound, may be contained, and means for dispensing from it.

The headgear/hat 12 is molded in form. The headgear/hat 12 includes a mount 22 or orifice, having a predetermined diameter, located in front, in the middle, above the generally flat bottom 24 of the headgear/hat 12. The headgear/hat 12 comprises a covering device for a head in the form of a hat-like recess 26, with a predetermined means 20 for keeping within it, an amount of substance, and means 26 for transporting said substance on the head, and means 14 for dispensing of the substance, from said headgear, from on said head, during any time, at any location.

The spigot 14 comprises two separate parts: a plug 36 (FIG. 6) and a tap 38 (FIG. 7). The plug 36 comprises a partially hollow pipe fitting for making a connection to the headgear/hat 12 by either insertion, or screwing on, to said headgear's/hat's mount 22. The tap 38 comprises a stout 40 and valve 32, attached to the end of the plug 36, to control the flow of a substance; a fluid, a gelatin, and or a solid.

Figure 11:
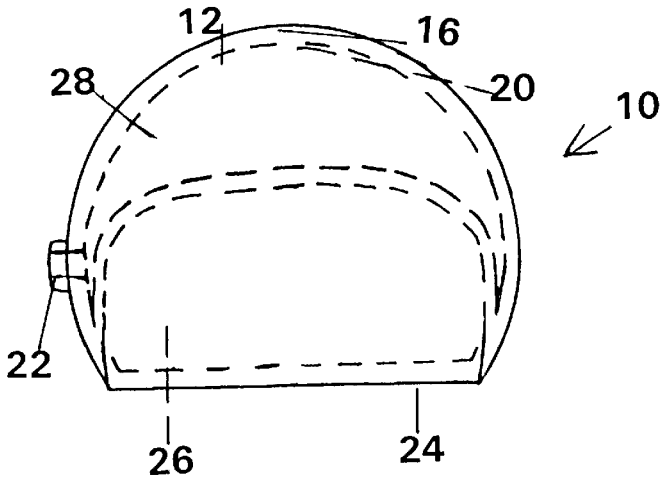
FIG. 11 is a side view of a ball-shaped container of the type shown in FIGS. 8 to 10.
Figure 12:
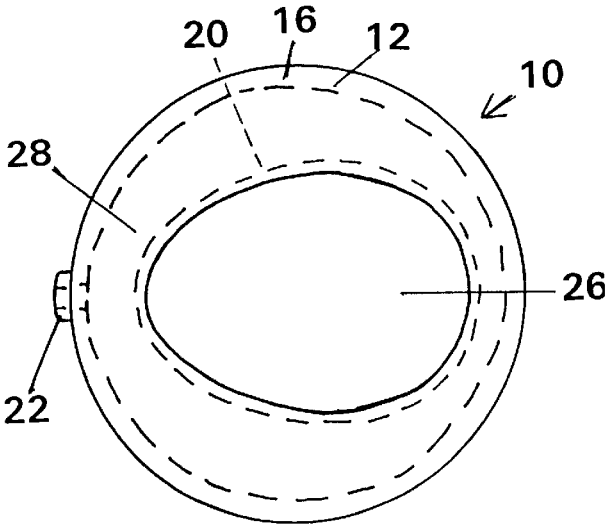
FIG. 12 is a bottom view of the ball-shaped container shown in FIG. 11.
Figure 13:
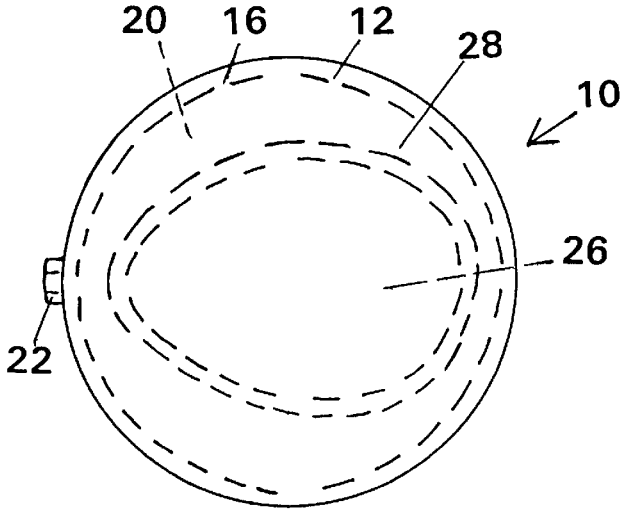
FIG. 13 is a top view of the ball-shaped container shown in FIG. 11.
Figure 15:
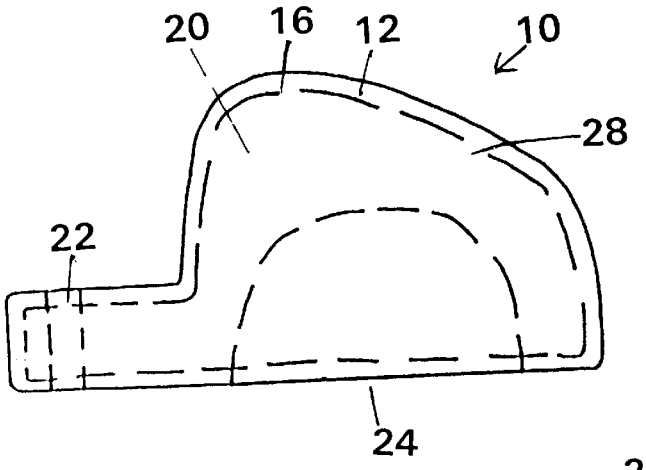
FIG. 15 is a side view of the hat-shaped container shown in FIG. 14.
Figure 16:
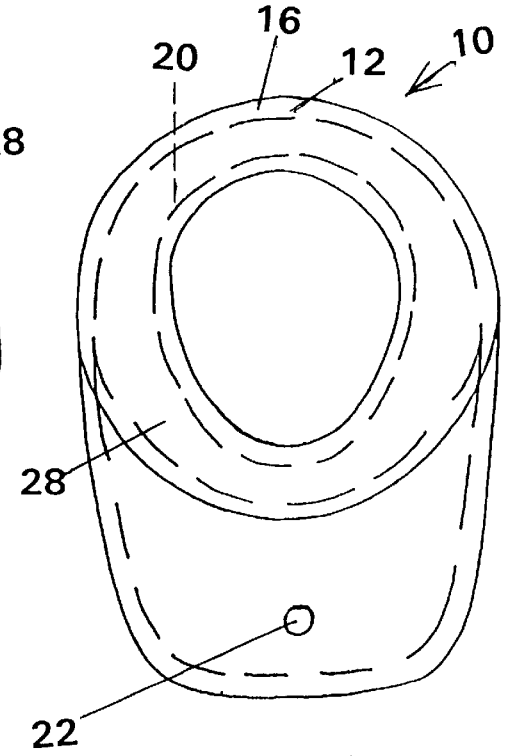
FIG. 16 is a side view of the hat-shaped container shown in FIG. 15.

FIGS. 1 to 4, 8 to 13, 14, and 15 to 16 show alternative embodiments of a wearable headgear/hat 12, comprising of a receptacle 28, including a chamber means 20 for holding a predetermined amount of a substance. The headgear/hat 12 also includes mount means 22 for attaching an appendage part (e.g, spigot 14) that allows for drawing, and regulating availability, or flow of the substance, from said receptacle. The headgear/hat 12 also includes a hat-like recess 26 for covering a person's head as a way for transporting the receptacle 28, and the connected appendage part 14, to, from, and at a location for dispensing of the substance. Whereby, while wearing the headgear/hat 12, a person can work, eat, and play, with means for holding, and dispensing a substance, to, from, and at a location, during any time.

As the Figures demonstrate, the exterior, or interior shape, structure of the headgear/hat 12, may be varied to provide a plurality of alternative shape embodiments of unlimited range. The unlimited range of shapes includes a predetermined spacial form of a particular item, or kind of item, comprising a standard, or universally recognized spatial form.

The headgear/hat 12 can include an interior, or exterior adjunct/fastener 18 for attaching, hanging, swinging, and or, suspending an object, upon its surface.

The headgear/hat 12 can include a slot/recess/pocket 19 for placing an object in, inside, on, or around it.

The headgear/hat 12 can include a predetermined substance, or material that allows for changing the exterior or interior temperature of the headgear/hat.

The headgear/hat 12 can include a bi-container version for holding and dispensing two separate substances. The bi-container may be disconnected and reconnected, by way of a predetermined method.

The color of the headgear/hat 12 may be varied to an unlimited range. The unlimited range of the color may be altered in tint or tone.

The headgear/hat 12 can include a predetermined material for making the headgear/hat 12 capable of holding and dispensing a substance, either singularly, or when joined.

The headgear/hat 12 can include an attached strap/belt/harness for securing the headgear/hat, on to a person's head to prevent loss of the headgear/hat, and, direct impact to the person's head.

The headgear/hat 12 can include a conduit/hose-like predetermined spigot for dispensing a substance that is operated from a person's mouth, to his/her self. The conduit/hose-like predetermined spigot on the headgear/hat is a means for holding and self-dispensing of said substance to oneself.

The headgear/hat 12 can include from its physical structure internally or externally, means for supporting a predetermined electrical device. The predetermined electrical device can include a cooling system; a heating system; an audio system, and or, a visual system.

The size of the headgear/hat 12 may be varied to a plurality of alternative embodiments, of unlimited range of predetermined physical magnitude, extent, or bulk of relative, or of proportionate dimensions.

The headgear/hat 12 can include a covering/wrap 16 constructed of a predetermined material for protecting; insulating, and for another predetermined purpose.

The spigot can include a predetermined male, and or female connector contact in any of its alternative embodiments to allow for interchangeability with a compatible male, and or female connector contact, on the headgear/hat, and any of its alternative embodiments.

The spigot 14 (see FIGS. 6 and 7) carries a valve 32 including an external handle 34 (see FIG. 1) to manually move the valve 32 between an opened and a closed position. In the opened position, the valve 32 opens communication with the chamber 20 to dispense the substance by gravity, suction, pressure or levity flow when the container 20 is in the freestanding condition. In the closed position, the valve 32 closes communication with the chamber 20 to retain the substance in the chamber 20.

The shape of the spigot 14 may be varied to a plurality of alternative shape embodiments of unlimited range. The unlimited range of shapes includes a predetermined spacial form of a particular item, or kind of item, comprising a standard, or universally recognized spatial form.

The spigot 14 can include a predetermined material (e.g., the valve 32) for holding and dispensing the substance.

The color of the spigot 14 may be varied to unlimited range in tint or tone.

The size of the spigot 14 may be varied to a plurality of alternative embodiments, of unlimited range of predetermined physical magnitude, extent, or bulk of relative, or of proportionate dimensions.

The spigot 14 can include a self-contained spigot comprising a tap and plug combination forming a single member (spigot).

The spigot 14 can include means for regulating availability, or flow of a substance: a liquid; a gelatin, and or, a solid by exerting a suction force produced by movements of the lips, and tongue, or to hold, or grip (especially with teeth), by which friction is created on the dispensing apparatus, or to expand, or distend with air, the internal pressure through the dispensing apparatus to urge the substance in to a person's mouth.

What is claimed is:

1. A transportable dispensing receptacle for a substance comprising a container enclosing a chamber to carry the substance, the container including a bottom wall defining a generally flat surface to maintain the container in an upright, freestanding condition when placed on a horizontal surface, a spigot spaced above the bottom wall and secured to the container in communication with the chamber, the spigot carrying a valve including an external handle to manually move the valve between an opened position, opening communication with the chamber to dispense the substance by gravity, suction, pressure or levity flow when the container is in the freestanding, upright condition, and a closed position, closing communication with the chamber to retain the substance in the chamber, and a hat-like recess formed within the bottom wall sized for wearing on an individual's head and for maintaining the container in the upright, freestanding condition during hands-free ambulation of the individual.

2. A receptacle according to claim 1 wherein the container includes a mount for the spigot including means for removing the spigot from the mount for repair or replacement with another spigot.

3. A receptacle according to claim 1 wherein the container includes an identifiable spatial form.

4. A receptacle according to claim 1 wherein the spigot includes an identifiable spatial form.

5. A receptacle according to claim 1 wherein the container includes a fitting or recess to support an external object.

6. A receptacle according to claim 1 wherein the container encloses a second chamber to carry a substance, and further including a second spigot in communication with the second chamber.

7. A receptacle according to claim 1 and further including insulating material surrounding the chamber.

8. A transportable receptacle for dispensing a substance comprising a container enclosing a chamber to carry the substance, the container including a bottom wall defining a generally flat surface to maintain the container in an upright, freestanding condition when placed on a horizontal surface, a mount in the container spaced away from the bottom wall, a family of spigots presenting different identifiable spacial forms, the spigots being constructed and arranged for interchangeable placement on or in the mount in communication with the chamber, each spigot including a valve to regulate gravity, suction, pressure or levity flow of the substance through the spigot when the container is in the freestanding, upright condition, and a hat-like recess formed within the bottom wall sized for wearing on an individual's head and for maintaining the container in the upright, freestanding condition during hands-free ambulation of the individual.

9. A receptacle according to claim 8 wherein the valve of at least one of the spigots includes an external handle to manually move the valve between an opened position, opening communication with the chamber to dispense the substance by gravity, suction, pressure or levity flow when the container is in the freestanding, upright condition, and a closed position, closing communication with the chamber to retain the substance in the chamber.

10. A receptacle according to claim 8 wherein the container includes an identifiable spatial form.

11. A family of transportable receptacles for dispensing substances comprising a family of containers presenting different identifiable spacial forms, each container enclosing a chamber to carry a substance and including a bottom wall defining a generally flat surface to maintain the container in an upright, freestanding condition when placed on a horizontal surface, a mount spaced from the bottom wall, and a hat-like recess formed within the bottom wall sized for wearing on an individual's head and for maintaining the container in the upright, freestanding condition during hands-free ambulation of the individual, and a family of spigots presenting different identifiable spacial forms, each spigot being constructed and arranged for interchangeable placement on or in the mount in communication with the chamber, each spigot including a valve to regulate flow of the substance by gravity, suction, pressure or levity through the spigot when the container is in the freestanding, upright condition.

12. A receptacle according to claim 11 wherein the valve of at least one of the spigots includes an external handle to manually move the valve between an opened position, opening communication with the chamber to dispense the substance by gravity, suction, pressure or levity flow when the container is in the freestanding, upright condition, and a closed position, closing communication with the chamber to retain the substance in the chamber.

* * * * *